US008472845B2

(12) United States Patent
Hayashi et al.

(10) Patent No.: US 8,472,845 B2
(45) Date of Patent: Jun. 25, 2013

(54) DEVELOPING DEVICE AND IMAGE FORMING APPARATUS HAVING THE DEVELOPING DEVICE

(75) Inventors: Shigeki Hayashi, Osaka (JP); Takafumi Nagai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 170 days.

(21) Appl. No.: 13/178,860

(22) Filed: Jul. 8, 2011

(65) Prior Publication Data

US 2012/0014719 A1 Jan. 19, 2012

(30) Foreign Application Priority Data

Jul. 15, 2010 (JP) ..... 2010-160800

(51) Int. Cl.
*G03G 15/08* (2006.01)

(52) U.S. Cl.
USPC ..... 399/256

(58) Field of Classification Search
USPC ..... 399/254–256
See application file for complete search history.

(56) References Cited

U.S. PATENT DOCUMENTS

| | | | | |
|---|---|---|---|---|
| 5,189,474 | A * | 2/1993 | Miya et al. | 399/255 |
| 5,617,192 | A * | 4/1997 | Tonomoto et al. | 399/263 |
| 5,682,584 | A * | 10/1997 | Hattori et al. | 399/255 |
| 6,122,472 | A * | 9/2000 | Sako et al. | 399/254 |
| 6,615,014 | B2 | 9/2003 | Sugihara | |
| 8,270,882 | B2 * | 9/2012 | Mihara et al. | 399/256 |
| 2004/0213603 | A1 | 10/2004 | Shigeta et al. | |
| 2008/0085137 | A1 | 4/2008 | Suzuki | |

FOREIGN PATENT DOCUMENTS

| | | | |
|---|---|---|---|
| JP | 58219575 | A * | 12/1983 |
| JP | 59-114557 | | 7/1984 |
| JP | 05-019621 | | 1/1993 |
| JP | 07-244425 | | 9/1995 |
| JP | 10-039593 | | 2/1998 |
| JP | 11-143192 | | 5/1999 |
| JP | 2001042616 | A * | 2/2001 |
| JP | 2007-33692 | | 2/2007 |
| JP | 2007-148183 | | 6/2007 |

* cited by examiner

*Primary Examiner* — Clayton E Laballe
*Assistant Examiner* — Leon W Rhodes, Jr.
(74) *Attorney, Agent, or Firm* — Nixon & Vanderhye, P.C.

(57) ABSTRACT

A developing device comprising: a developer tank housing a developer including a toner and a carrier; a toner replenishment port; a developing roller; a first developer conveying path and a second developer conveying path; a conducting plate for peeling a recovery developer on a surface of the developing roller after the toner is supplied to a photosensitive drum from the surface of the developing roller so as to guide the recovery developer to the first developer conveying path; and first and second developer conveying members arranged on the first and second developer conveying paths, wherein the first developer conveying member has a cylindrical hollow rotating shaft with opened both ends that is rotatably provided to the first developer conveying path, and divides the first developer conveying path into an external first developer conveying path and an internal first developer conveying path, an external spiral blade fixed to an outer periphery of the hollow rotating shaft, and an internal spiral blade fixed to an inner periphery of the hollow rotating shaft, a direction where the developer is conveyed by the external spiral blade is the same as a direction where the developer is conveyed by the second developer conveying member and is opposite to a direction where the developer is conveyed by the internal spiral blade.

8 Claims, 17 Drawing Sheets

DEVELOPING DEVICE AND IMAGE FORMING APPARATUS HAVING THE DEVELOPING DEVICE

CROSS-REFERENCE TO RELATED APPLICATION

This application is related to Japanese patent application No. 2010-160800 filed on Jul. 15, 2010 whose priority is claimed under 35 USC §119, the disclosure of which is incorporated by reference in its entirety.

BACKGROUND OF THE INVENTION

1. Field of the Invention

The present invention relates to a developing device using a two-component developer and an image forming apparatus having the developing device.

2. Description of the Related Art

In recent years, a two-component developer (hereinafter, simply "developer") having excellent toner charging stability is widely used in electrophotographic type image forming apparatuses that cope with full colors and high image quality.

This developer is composed of a toner and a carrier. The toners and carriers are agitated in a developer tank of a developing device and they are rubbed so that the toner that is suitably charged by the rubbing can be obtained.

In the developing device, the charged toner is supplied to a surface of a developing roller, and is transferred from the developing roller to an electrostatic latent image formed on a surface of a photosensitive drum by an electrostatic attractive force. As a result, a toner image is formed on the photosensitive drum based on the electrostatic latent image.

Recently, there is a demand for a high-speed, miniaturized image forming apparatuses. Accordingly, it is necessary to charge a developer quickly and sufficiently, and convey the developer quickly.

For this reason, as a conventional technique 1, a circulation type developing device is proposed (for example, see Japanese Patent Application Laid-Open No. 2001-255723). This developing device has first and second developer conveying paths, first and second connecting paths and first and second auger screws. The first and second developer conveying paths are partitioned by a partition wall provided in a developer tank. The first and second connecting paths connect the first developer conveying path and the second developer conveying path at both ends. The first and second auger screws are arranged on the first and second developer conveying paths and convey the developer to opposite directions. The developing device circulates the developer in the first and second developer conveying paths, and draws the developer in the second developer conveying path to supply it to the photosensitive drum. Thereafter, the developing device returns the developer from the photosensitive drum to the second developer conveying path.

In a case of the image forming apparatus of the conventional technique 1, when an image whose image density is locally high is printed and thus a toner in the developer on a developing roller is consumed locally and notably, the toner density in the developer on the developing roller is locally low.

Such a developer with low toner density is returned into the second developer conveying path. When the developer with low toner density is supplied again to the developing roller before being mixed with another developer sufficiently, an amount of toner to be supplied to the photosensitive drum is locally reduced. As a result, unevenness of image density (a phenomenon as so-called "development memory") occurs. This phenomenon such that the image density of a printed image obtained by printing an image with locally high density is locally low.

In order to solve this problem, a conventional technique 2 proposes the following developing device. This developing device has first and second developer conveying paths, first and second connecting paths, first and second auger screws, a third developer conveying path, and a third auger screw. The first and second developer conveying paths are partitioned by a partition wall provided into a developer tank. The first and second connecting paths connect the first developer conveying path and the second developer conveying path at both ends. The first and second auger screws are arranged in the first and second developer conveying paths and convey a developer to opposite directions. The third developer conveying path is arranged above the first and second developer conveying paths. The third auger screw is arranged in the third developer conveying path. The developing device circulates the developer in the first and second developer conveying paths, and draws the developer in the second developer conveying path so as to supply the developer to a photosensitive drum. Thereafter, the developing device returns the developer to the first developer conveying path via the third developer conveying path, so that occurrence of the unevenness of image density is repressed. There is a conventional technique disclosed in Japanese Patent Application Laid-Open No. 2008-26408.

However, in the developing device of the conventional technique 2, three developer conveying paths and three auger screws are necessary for repressing the occurrence of unevenness of image density, and thus the developing device is enlarged and is complicated.

SUMMARY OF THE INVENTION

In view of such a problem, it is an object of the present invention to provide a developing device in which even if an image with locally high image density is printed, occurrence of unevenness of density of an image to be printed can be repressed without enlarging the developing device, and an image forming apparatus having the developing device.

According to the present invention, a developing device, which is attached to an electrophotographic type image forming apparatus having a photosensitive drum on which an electrostatic latent image is formed, includes: a developer tank housing a developer including a toner and a carrier; a toner replenishment port for replenishing a toner into the developer tank; a developing roller that is provided in the developer tank and supplies the toner to a surface of the photosensitive drum formed with the electrostatic latent image while bearing the developer and rotating; a developer conveying path having a first developer conveying path and a second developer conveying path on a side of the developing roller in which the first and second developer conveying paths are partitioned by a partition wall parallel with an axial direction of the developing roller, and a connecting path for connecting the first and second developer conveying paths at both sides of the axial direction; a conducting plate for peeling a recovery developer on the surface of the developing roller after the toner is supplied to the photosensitive drum from the surface of the developing roller so as to guide the recovery developer to the first developer conveying path; and first and second developer conveying members arranged on the first and second developer conveying paths. The first developer conveying member has a cylindrical hollow rotating shaft with opened both ends that is rotatably provided to the first developer conveying path, and divides the first developer conveying path into an external first developer conveying path and an internal first developer conveying path, an external spiral blade fixed to an outer periphery of the hollow rotating shaft, and an internal spiral blade fixed to an inner periphery of the hollow rotating shaft. A direction where the developer is conveyed by the external spiral blade is the same as a direction where the developer is conveyed by the second developer conveying member and is opposite to a direction where the developer is conveyed by the internal spiral blade.

Another aspect of the present invention provides an image forming apparatus including: a photosensitive drum on which an electrostatic latent image is formed; a charging device for charging a surface of the photosensitive drum; an exposing device for forming an electrostatic latent image on the surface of the photosensitive drum; the developing device for supplying a toner to the electrostatic latent image on the surface of the photosensitive drum so as to form a toner image; a toner replenishment device for replenishing a toner to the developing device; a transfer device for transferring the toner image on the surface of the photosensitive drum onto a recording medium; and a fixing device for fixing the toner image onto the recording medium.

According to the developing device of the present invention, the developer is refluxed between the internal first developer conveying path and the second developer conveying path. A part of the developer in the second developer conveying path is supplied to the developing roller, and a toner is supplied from the developer on the developing roller to the photosensitive drum. A recovery developer with low toner density on the developing roller is guided to the external first developer conveying path along the conducting plate so as to be conveyed to an upstream side of the internal first developer conveying path.

That is to say, the recovery developer whose toner density is lowered is not returned directly to the second developer conveying path. For this reason, a local fluctuation in the toner density in the second developer conveying path is repressed.

Therefore, even after an image whose image density is locally high is printed, a defect such that the density of an image to be printed later is locally lowered (development memory) is repressed.

In a structure such that the recovery developer is conveyed so as not to be mixed with a developer in the second developer conveying path, new developer conveying path and developer conveying member are not additionally provided. For this reason, the developing device can be made to be compact.

Accordingly, a compact image forming apparatus in which unevenness of the image density is prevented can be obtained.

DETAILED DESCRIPTION OF THE PREFERRED EMBODIMENTS

Figure 1:
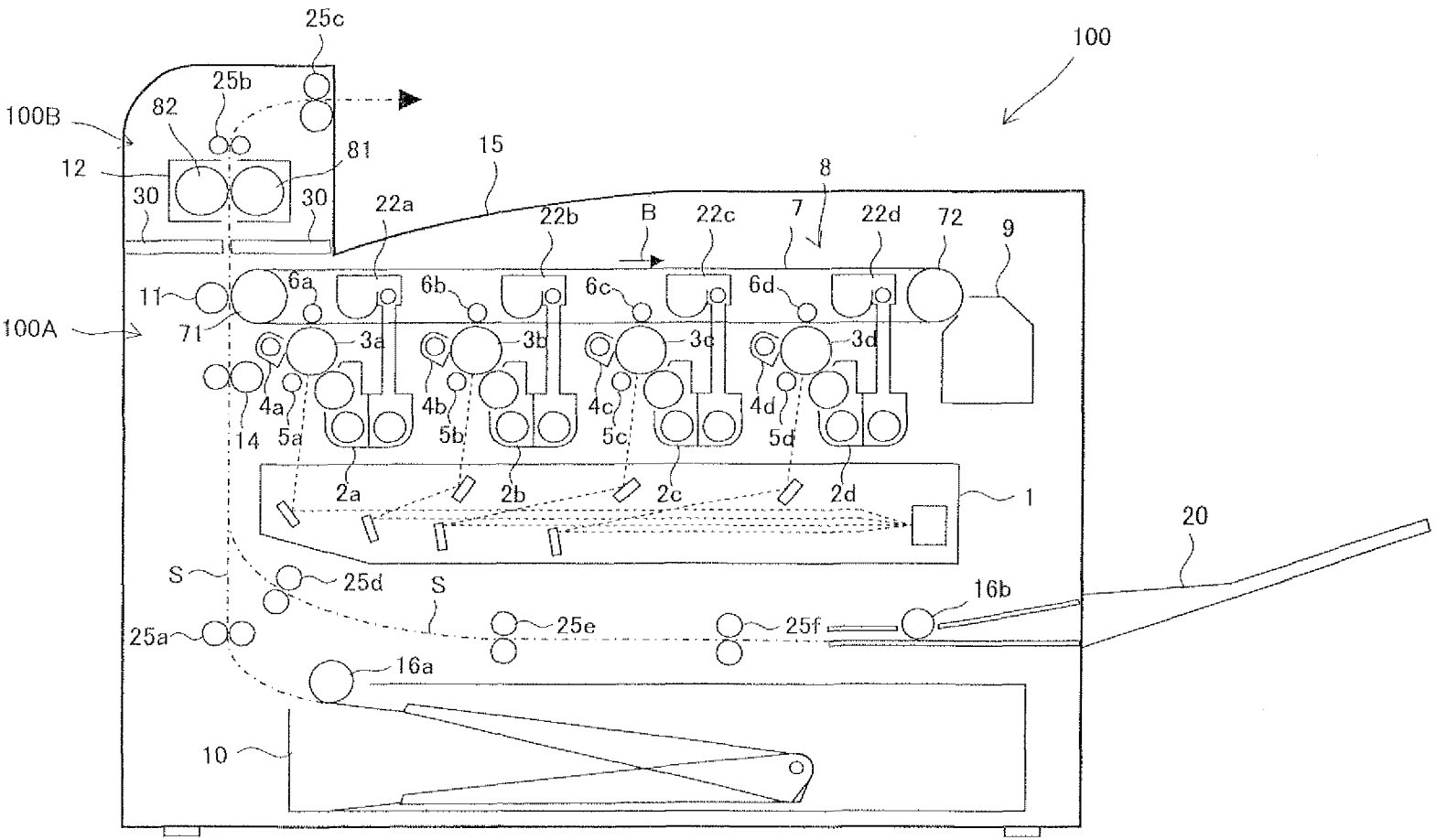
FIG. 1 is an explanatory diagram illustrating an entire constitution of an image forming apparatus having a developing device (first embodiment) of the present invention.

A developing device of the present invention is a circulation type developing device that includes a developer tank, a toner replenishment port, a developing roller, a developer conveying path having first and second developer conveying paths and a connecting path, the first and second developer conveying members, and a conducting plate. The developing device is attached to an electrophotographic type image forming apparatus such as monochrome or full-color copying machines, printers and facsimile apparatuses, and complex machine having these functions.

In this developing device, the first developer conveying member has a cylindrical hollow rotating shaft with opened both ends, an external spiral blade, and an internal spiral blade. The hollow rotating shaft is rotatably provided to a first developer conveying path, and divides the first developer conveying path into an external first developer conveying path and an internal first developer conveying path. The external spiral blade is fixed to an outer periphery of the hollow rotating shaft. The internal spiral blade is fixed to an inner periphery of the hollow rotating shaft.

A shape, a position and a number of the openings at both the ends of the hollow rotating shaft are not particularly limited as long as a developer outside the hollow rotating shaft can be circulated from one end of the hollow rotating shaft to the inside and can be discharged outside.

A direction where a developer is conveyed by the external spiral blade is the same as a direction where a developer is conveyed by the second developer conveying member, and is opposite to a direction where a developer is conveyed by the internal spiral blade.

The external spiral blade and the internal spiral blade of the first developer conveying member may establish a relationship with the second developer conveying member so that the developer is conveyed as described above. Therefore, spiral directions of the external and internal spiral blades are not particularly limited. Also when the second developer conveying member is a screw type shaft (auger screw) having a rotating shaft and a spiral blade fixed to an outer periphery of the rotating shaft, a spiral direction of the spiral blade is not limited.

The circulation-type developing device circulates a developer in the internal first developer conveying path and the second developer conveying path, and draws a part of the developer in the second developer conveying path using the developing roller to supply it to the photosensitive drum.

Thereafter, the developing device introduces a recovery developer that is borne by the developing roller and should be recovered into the external first developer conveying path using the conducting plate, and leads the recovery developer from the external first developer conveying path to the internal first developer conveying path.

Hereinafter, in some cases, "developer conveying direction" is simply referred to as "conveying direction". Further, "upstream side" and "downstream side" mean "upstream side of the conveying direction" and "downstream side of the conveying direction".

The developing device of the present invention may be constituted as follows concretely, or respective constitutions may be combined.

(1) The first developer conveying member includes a periphery connecting port and a developer drawing blade. The periphery connecting port is formed on a cylinder periphery of the hollow rotating shaft on the downstream side of the developer conveying direction in the external first developer conveying path. The periphery connecting port connects the external first developer conveying path and the internal first developer conveying path. The developer drawing blade is fixed to a vicinity of the periphery connecting port on the outer periphery of the hollow rotating shaft. The developer drawing blade leads a developer on a side of the external first developer conveying member to the internal first developer conveying path via the periphery connecting port at the time of rotation of the first developer conveying member.

As a result, when the developer in the external first developer conveying path is led to the internal first developer conveying path, compression of the developer towards a downstream side wall surface of the external first developer conveying path can be repressed. Therefore, deterioration in fluidity of the developer caused by a stress on the developer can be prevented.

(2) The second developer conveying member includes a rotating shaft, and a spiral blade fixed to an outer periphery of the rotating shaft. A position of a shaft center of the first developer conveying member is set to be higher than a shaft center of the second developer conveying member in a vertical direction. A lower position of the first developer conveying member is set to be lower than the shaft center of the second developer conveying member in the vertical direction.

As a result, the developer is smoothly transferred from the first developer conveying path to the second developer conveying path in the connecting path on a downstream side of the internal first developer conveying path, and the developer is smoothly transferred from the second developer conveying path to the first developer conveying path in the connecting path on an upstream side of the internal first developer conveying path. As a result, stagnation of the developer near the connecting path can be repressed.

(3) The second developer conveying member includes a circumferential rotating plate that is fixed along a direction of the rotating shaft on the downstream side of the developer conveying direction on the outer periphery of the rotating shaft.

As a result, the developer on a downstream side of the second developer conveying path can be smoothly transferred to an upstream side of the internal first developer conveying path via the connecting path.

(4) The first developer conveying member includes a ring-shaped backflow preventing plate fixed to the upstream side of the developer conveying direction of the external first developer conveying path on the outer periphery of the hollow rotating shaft.

As a result, a recovery developer returned to the upstream side of the external first developer conveying path can be prevented from being mixed with the developer on the downstream side of the internal first developer conveying path and being supplied to the second developer conveying path. As a result, the following defect can be prevented. The defect is such that the recovery developer with noticeably low toner replenishment port density is transferred to the second developer conveying path before being sufficiently agitated and mixed with the developer on the downstream side of the internal first developer conveying path, and the part of the developer with low toner density is supplied to the developing roller, thereby causing the unevenness of image density.

(5) The first developer conveying member includes a side connecting port on the downstream side of the developer conveying direction of the internal first developer conveying path of the hollow rotating shaft.

As a result, since the developer conveyed to the downstream side of the hollow rotating shaft by the internal spiral blade transfers straight ahead without changing a direction so as to be discharged out of the hollow rotating shaft. For this reason, the developer can be prevented from remaining on the downstream side of the hollow rotating shaft. As a result, the following defect can be repressed. The defect is such that the developer remaining on the downstream side of the hollow rotating shaft is subject to a stress due to a pressure, and thus fluidity is deteriorated and a sufficient amount of the developer cannot be supplied to the developing roller.

(6) The toner replenishment port is arranged on the downstream side of the developer conveying direction of the external first developer conveying path.

The downstream side of the external first developer conveying path is a junction of the recovery developer conveyed from the upstream side of the external first developer conveying path and the developer conveyed from the downstream side of the second developer conveying path. For this reason, the amount of the developer is the largest.

Therefore, when the toner replenishment port is arranged on the downstream side of the external first developer conveying path, the following defect can be prevented. The defect is such that since the toner is replenished to a portion where the amount of the developer is the largest, the toner density of the developer becomes high locally and remarkably.

The developing device and the image forming apparatus having the developing device according to the present invention are described in detail below with reference to the drawings.

<First Embodiment>

FIG. 1 illustrates an entire configuration of the image forming apparatus including the developing device according to a first embodiment of the present invention. An image forming apparatus 100 including a developing device accommodation portion 100A in which plural developing devices 2*a* to 2*d* are accommodated in a casing, a fixing device accommodation portion 1008 in which a fixing device 12 is accommodated above the developing device accommodation portion 100A in the casing, and a division wall 30 that is provided between the developing device accommodation portion 100A and the fixing device accommodation portion 100B to insulate heat of the fixing device 12 such that the heat is not transferred onto a developing device side. For example, the image forming apparatus 100 is a printer that can form a multi-color or monochrome image on a sheet-like recording medium (recording sheet) according to externally-transmitted image data. An upper surface of the developing device accommodation portion 100A, located beside the fixing device accommodation portion 100B, constitutes a sheet discharge tray 15.

In the first embodiment, the image forming apparatus is the printer by way of example. Alternatively, the image forming apparatus may be a copying machine, a facsimile, or a complex machine having their functions, which can form the multi-color or monochrome image on the recording medium according to the externally-transmitted image data and/or image data scanned from an original by a scanner.

[Developing Device Accommodation Portion]

As illustrated in FIG. 1, the developing device accommodation portion 100A includes: four photosensitive drums 3*a*, 3*b*, 3*c*, and 3*d*; four chargers (charging device) 5*a*, 5*b*, 5*c*, and 5*d* that charge surfaces of the photosensitive drums 3*a* to 3*d*; an exposure unit (exposure device) 1 that forms electrostatic latent images on the surfaces of the photosensitive drums 3*a* to 3*d*; four developing devices 2*a*, 2*b*, 2*c*, and 2*d* in which black, cyan, magenta, and yellow toners are individually stored, the developing devices 2*a* to 2*d* developing the electrostatic latent images on the surfaces of the photosensitive drums 3*a* to 3*d* to form toner images; cleaner units 4*a*, 4*b*, 4*c*, and 4*d* that remove residual toners left on the surfaces of the photosensitive drums 3*a* to 3*d* after the development and image transfer; four toner replenishment devices 22*a*, 22*b*, 22*c*, and 22*d* that individually replenish the four color toners to the developing device 2*a* to 2*d*; an intermediate transfer belt unit (transfer device) 8 that transfers the toner image on the surface of the photosensitive drums 3*a* to 3*d* to the recording medium; and an intermediate transfer belt cleaning unit 9.

The developing device accommodation portion 100A also includes: a paper feeding tray 10 that is disposed in a lowermost part of the developing device accommodation portion 100A, the plural recording mediums being stored in the paper feeding tray 10; a manual paper feeding tray 20 that is disposed on one side surface of the developing device accommodation portion 100A, an irregular-size recording medium being set on the manual paper feeding tray 20; and a sheet conveyance path S through which the recording medium is conveyed to the intermediate transfer belt unit (transfer device) 8 from the paper feeding tray 10 or the manual paper feeding tray 20. In the members designated by the numerals "a" to "d", the numeral "a" designates the member used to form the black image, the numeral "b" designates the member used to form the cyan image, the numeral "c" designates the member used to form the magenta image, and the numeral "d" designates the member used to form the yellow image.

In the image forming apparatus 100, the black toner image, the cyan toner image, the magenta toner image, and the yellow toner image are selectively formed on the surfaces of the photosensitive drums 3*a* to 3*d* based on the image data of the black, cyan, magenta, and yellow color components, and the formed toner images are superposed on the intermediate transfer belt unit 8 to form a color image on the recording medium. Because the photosensitive drums 3*a* to 3*d* corresponding to the colors have the same configuration, the numerals 3*a* to 3*d* are unified by the numeral 3 in the description of the configurations of the photosensitive drums 3*a* to 3*d*. Similarly, the numerals 2*a* to 2*d* are unified by the numeral 2 in the developing device, the numerals 5*a* to 5*d* are unified by the numeral 5 in the charger, the numerals 4*a* to 4*d* are unified by the numeral 4 in the cleaner unit, and the numerals 22*a* to 22*d* are unified by the numeral 22 in the toner replenishment device.

(Photosensitive Drum and Peripheral Members Thereof)

The photosensitive drum 3 includes a conductive base body and a photosensitive layer that is formed on a surface thereof, and the photosensitive drum 3 is a cylindrical member that forms the latent image by the charging and the exposure. The photosensitive drum 3 exhibits a conductive property by light irradiation, and an electric image called the electrostatic latent image is formed on the surface thereof. The photosensitive drum 3 is supported by a driving section (not illustrated) so as to be able to rotate about a shaft line.

For example, a contact roller type charger, a contact brush type charger, or a non-contact type charger is used as the charger 5 to evenly charge the surface of the photosensitive drum 3 at a predetermined potential.

The exposure unit 1 causes light corresponding to the image data to pass between the charger 5 and the developing device 2, and irradiates the surface of the charged photosensitive drum 3 with the light to perform the exposure, thereby forming the electrostatic latent image corresponding to the image data on the surface of the photosensitive drum 3. In the first embodiment, a Laser Scanning Unit (LSU) including a laser irradiation portion and a reflecting mirror is used as the exposure unit 1 by way of example. Alternatively, an EL (Electroluminescence) or LED write head in which light emitting element are arrayed may be used as the exposure unit 1.

(Developing Device)

Figure 2:
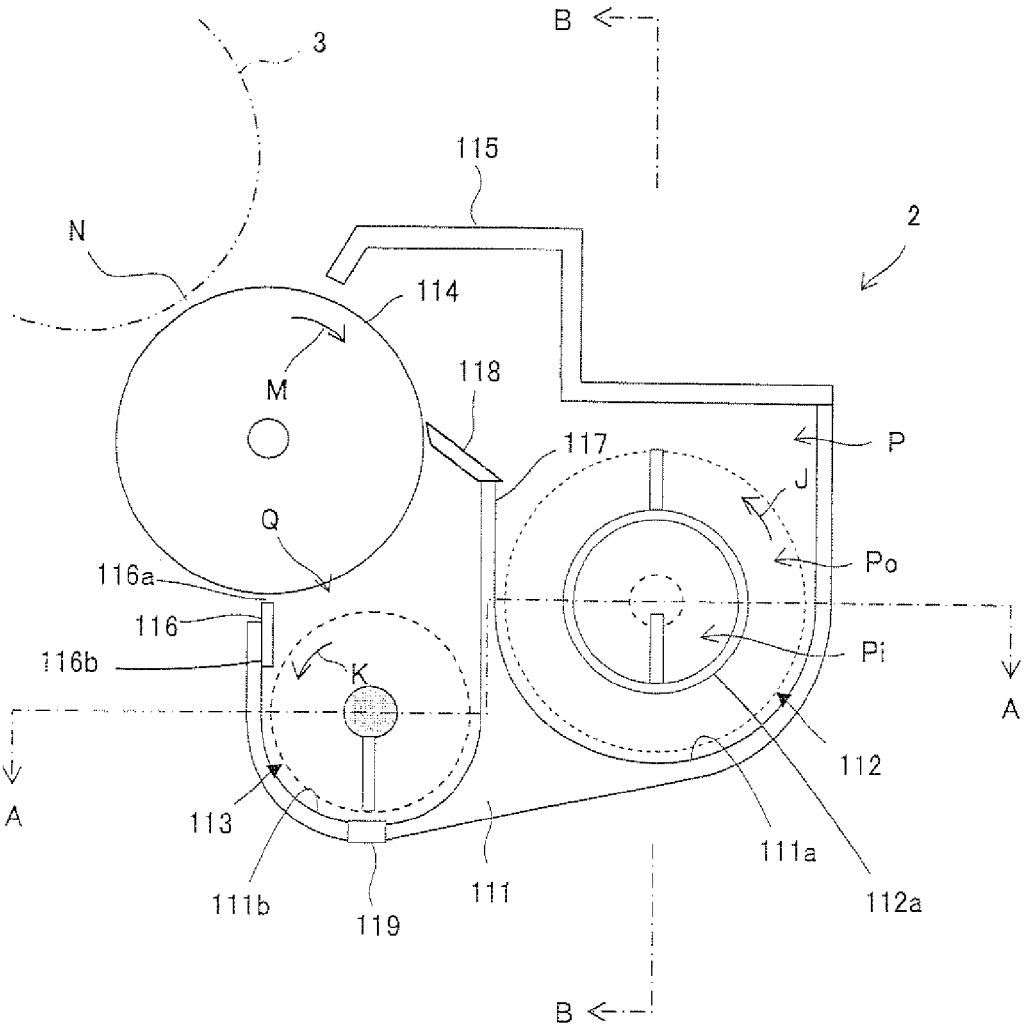
FIG. 2 is an enlarged diagram of the developing device shown in FIG. 1.
Figure 3:
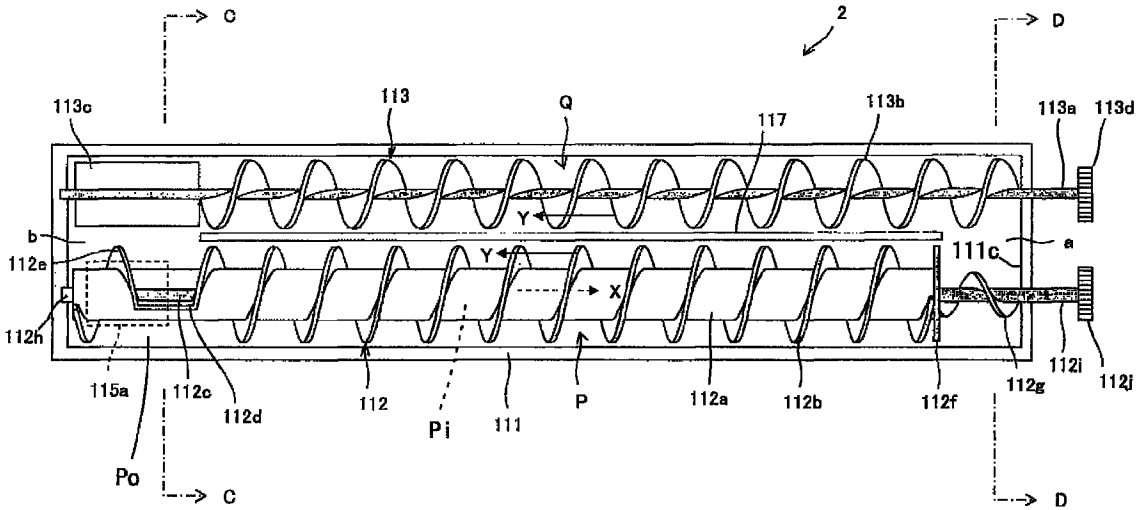
FIG. 3 is a fragmentary view taken in line A-A of FIG. 2.
Figure 4:
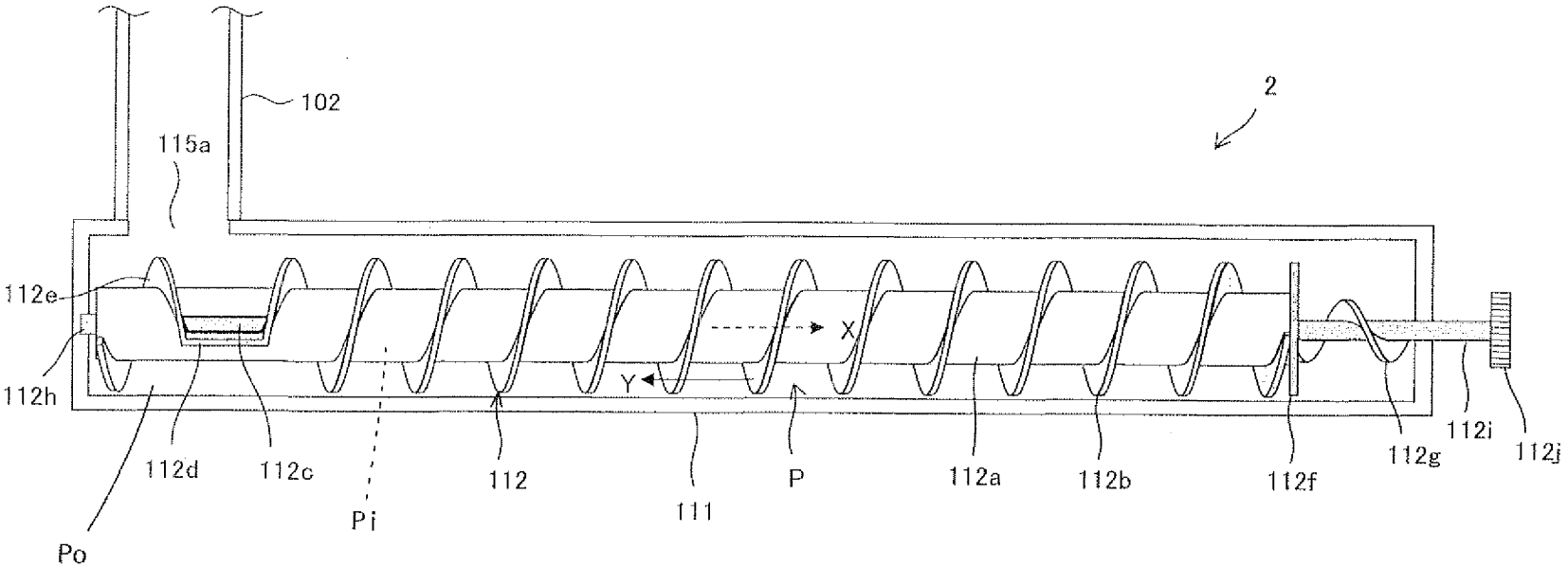
FIG. 4 is a fragmentary view taken in line B-B of FIG. 2.
Figure 5:
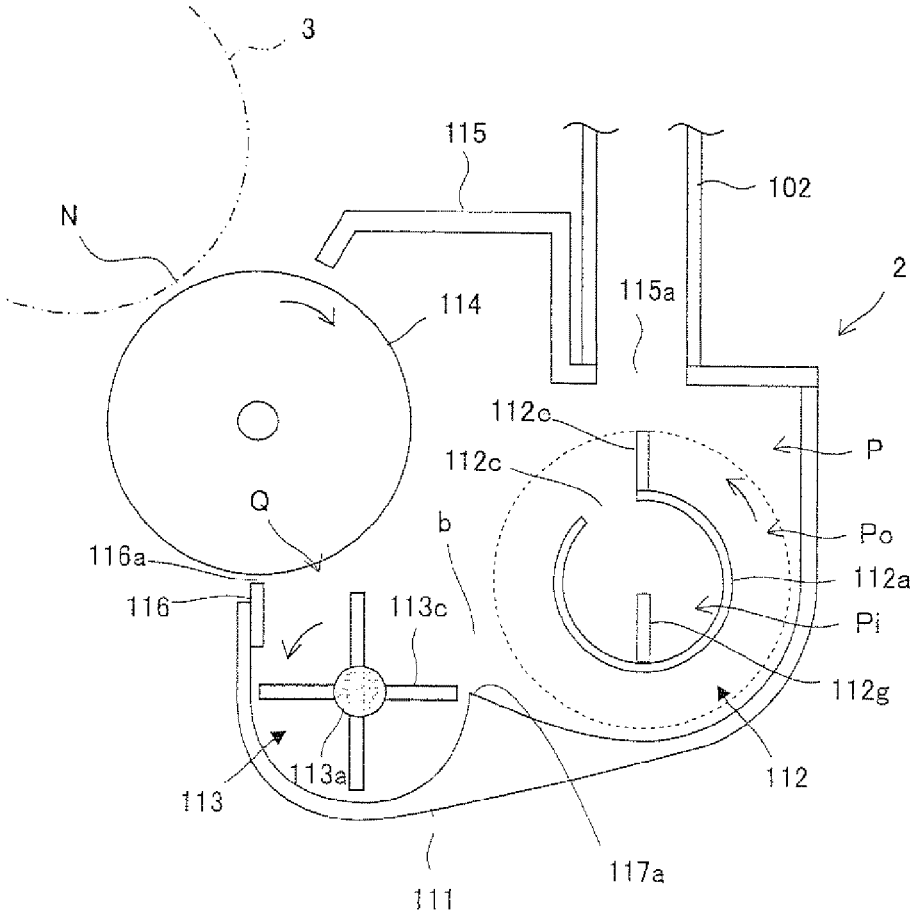
FIG. 5 is a fragmentary view taken in line C-C of FIG. 3.
Figure 6:
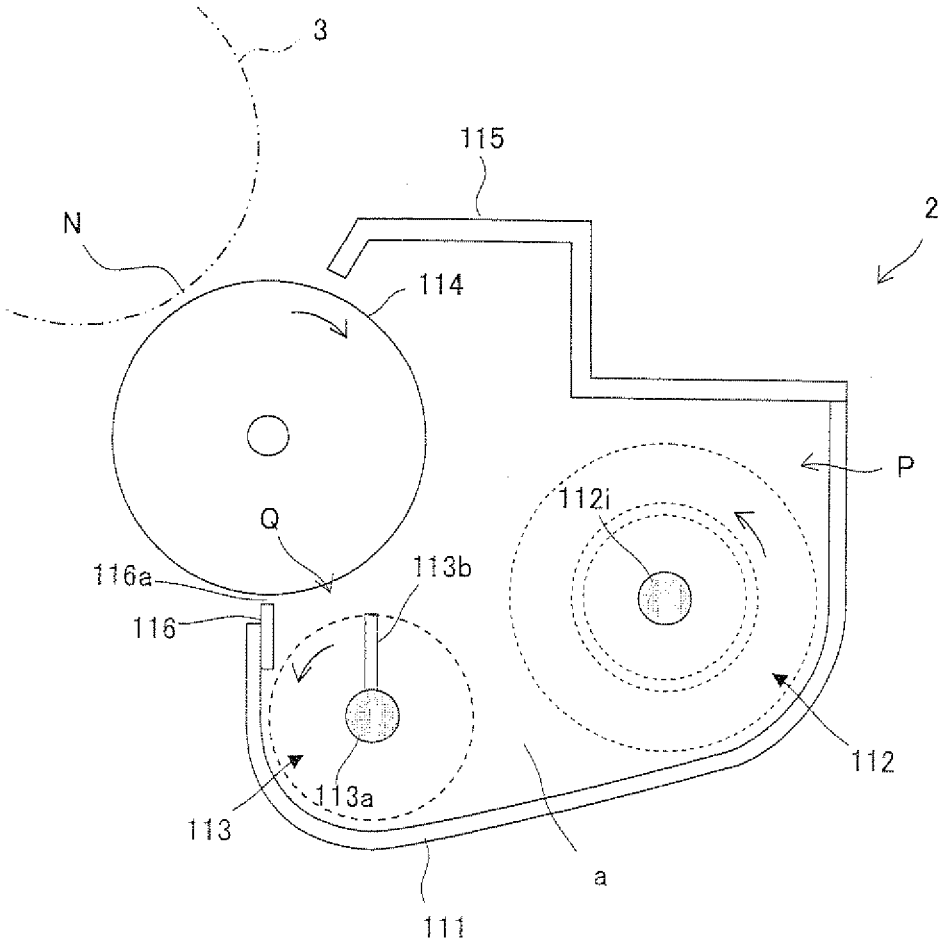
FIG. 6 is a fragmentary view taken in line D-D of FIG. 3.

FIG. 2 is an enlarged diagram illustrating the developing device shown in FIG. 1. FIG. 3 is a fragmentary view taken in line A-A of FIG. 2, FIG. 4 is a fragmentary view taken in line B-B of FIG. 2, FIG. 5 is a fragmentary view taken in line C-C of FIG. 3, and FIG. 6 is a fragmentary view taken in line D-D of FIG. 3. In these drawings, the developer housed in a developer tank 111 is not shown in the drawings.

Figure 7:
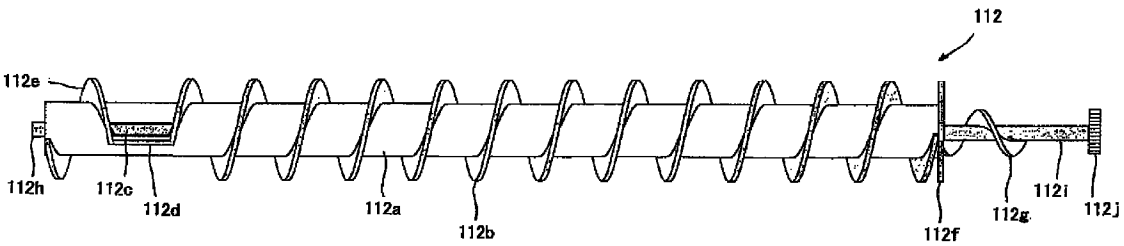
FIG. 7 is an enlarged diagram illustrating a first developer conveying member shown in FIG. 3.
Figure 8:
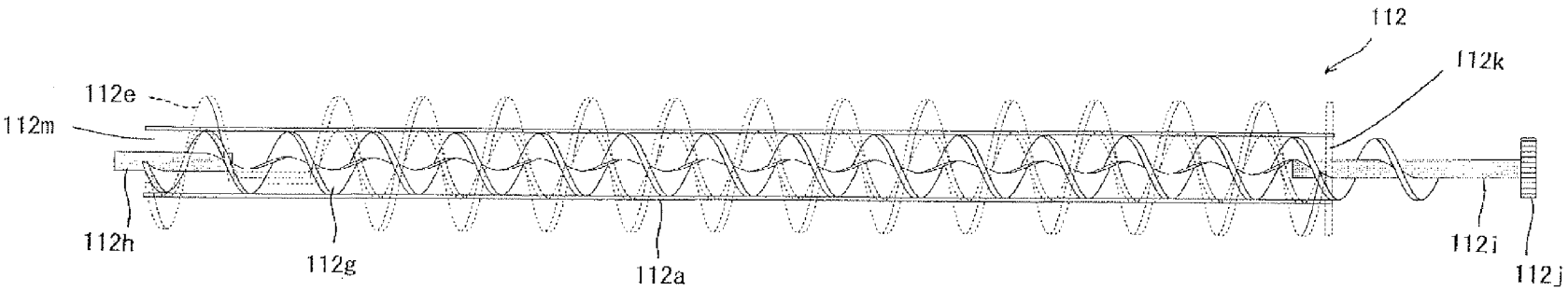
FIG. 8 is a perspective view illustrating the first developer conveying member shown in FIG. 7.
Figure 9:
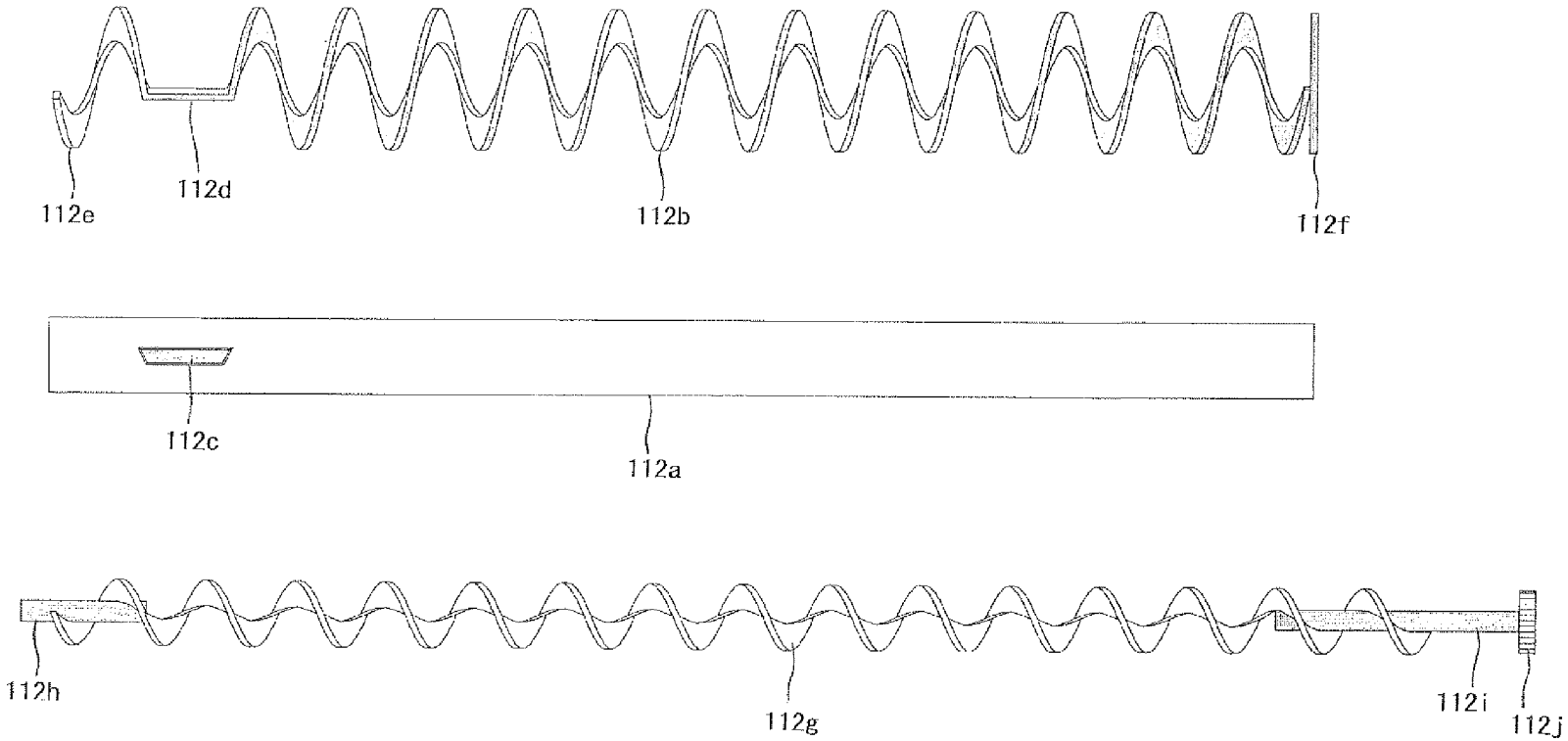
FIG. 9 is an exploded view illustrating the first developer conveying member shown in FIG. 7.
Figure 10:
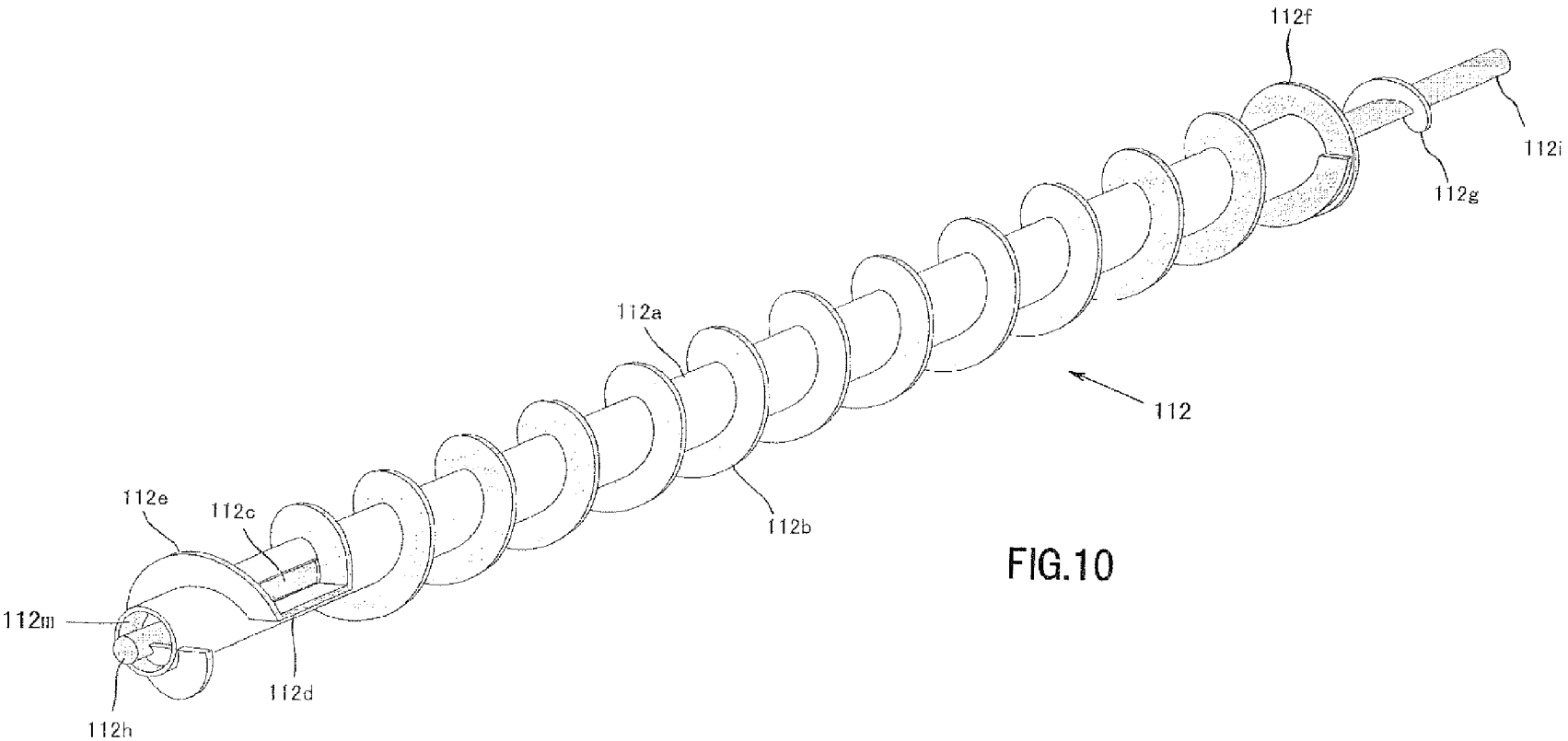
FIG. 10 is a perspective view illustrating the first developer conveying member shown in FIG. 7.
Figure 11:
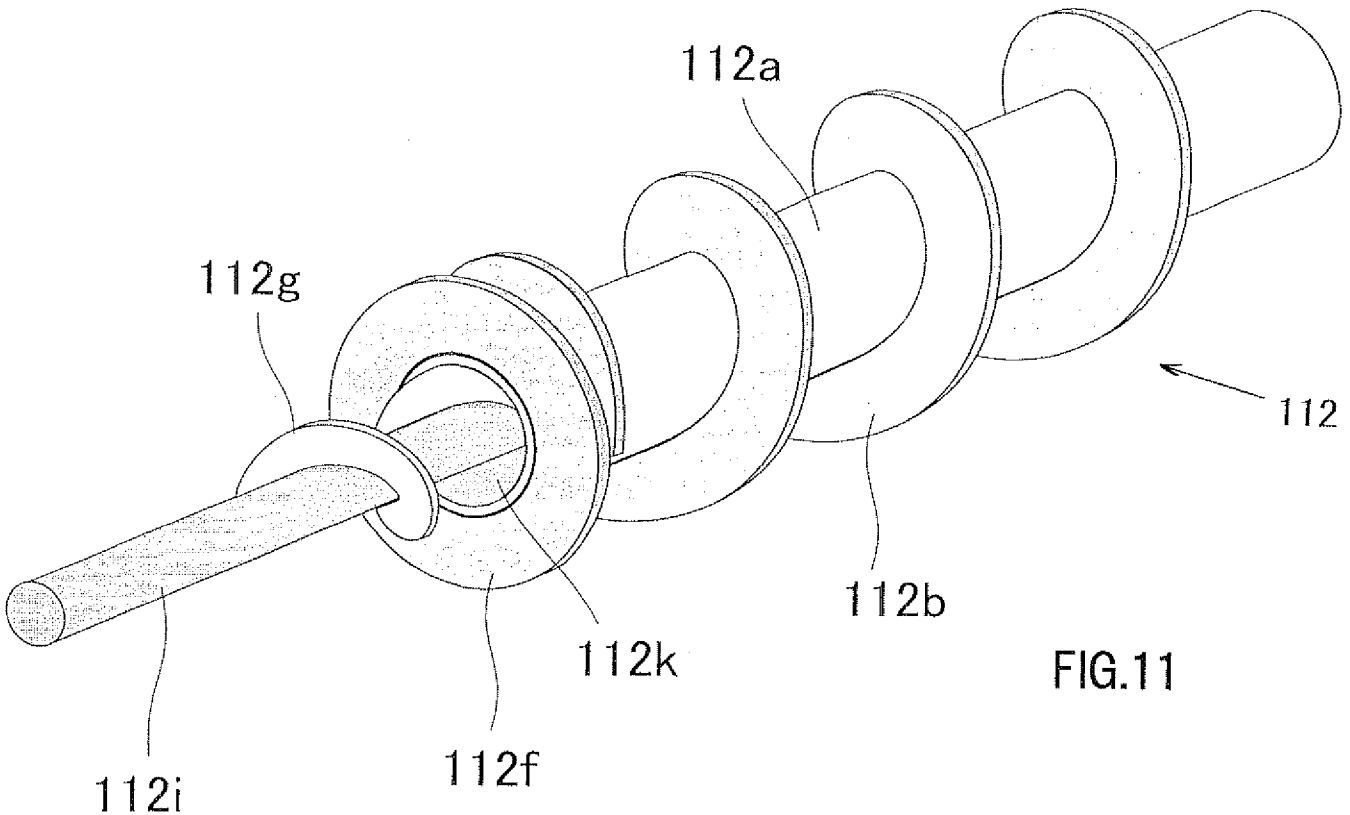
FIG. 11 is a perspective view where the first developer conveying member shown in FIG. 10 is viewed from an opposite direction.
Figure 12:
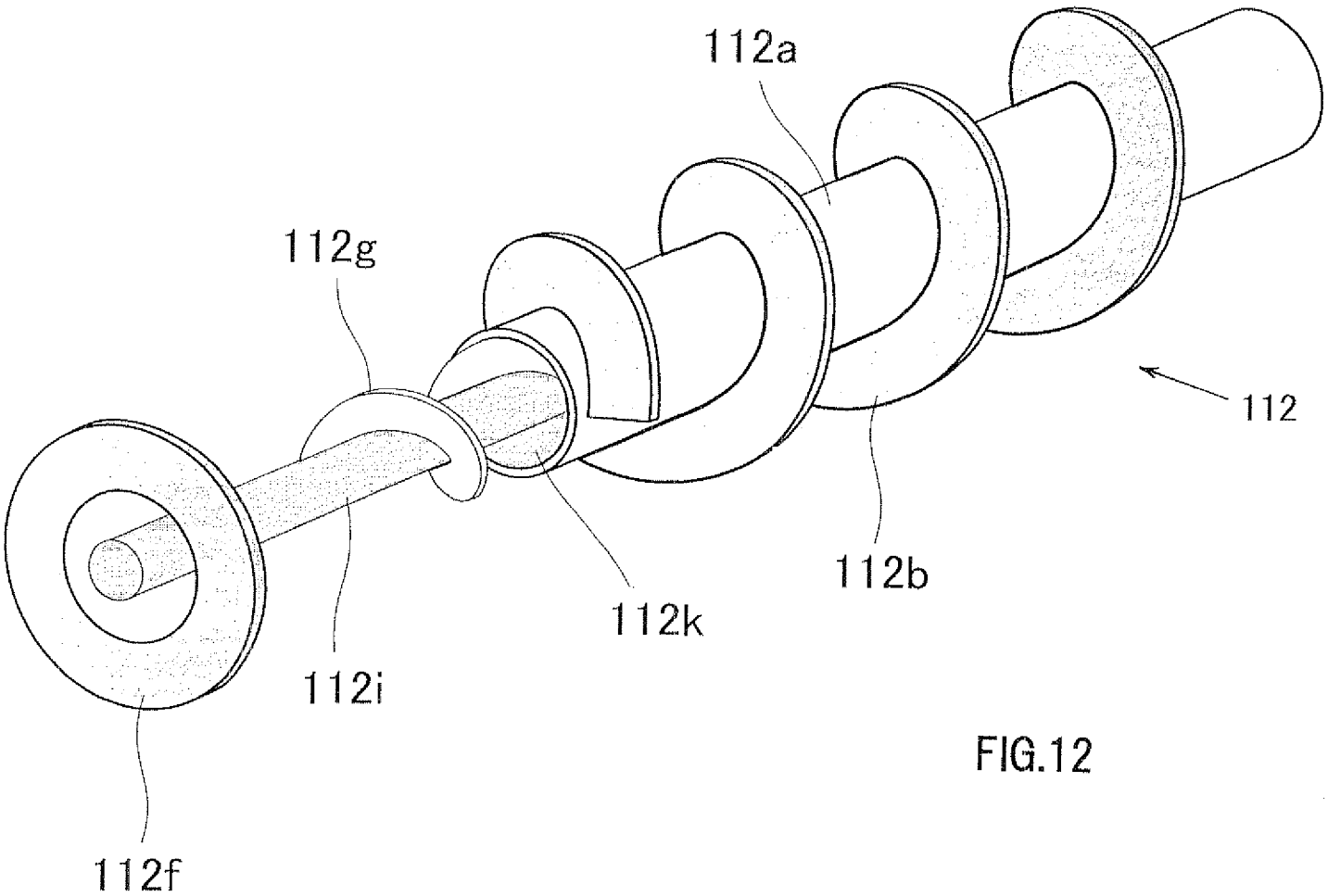
FIG. 12 is an exploded view illustrating the first developer conveying member shown in FIG. 11.

FIG. 7 is an enlarged diagram illustrating the first developer conveying member shown in FIG. 3, and FIG. 8 is a perspective view illustrating the first developer conveying member shown in FIG. 7. FIG. 9 is an exploded view illustrating the first developer conveying member shown in FIG. 7, and FIG. 10 is a perspective view illustrating the first developer conveying member shown in FIG. 7. FIG. 11 is a perspective view where the first developer conveying member shown in FIG. 10 is viewed from an opposite direction, and FIG. 12 is an exploded view illustrating the first developer conveying member shown in FIG. 11.

A developing device 2 includes a developer tank 111 having an approximately rectangular parallelpiped container shape, a toner replenishment port 115*a*, a developing roller 114, first and second developer conveying paths P and Q, first and second connecting paths "a" and "b", first and second developer conveying members 112 and 113, a doctor blade 116, a toner density detecting sensor (magnetic permeability sensor) 119, and a conducting plate 118. The developer tank 111 houses a developer containing a toner and a carrier. The toner replenishment port 115*a* is for replenishing the toner into the developer tank 111. The developing roller 114 is provided into the developer tank 111. The first and second developer conveying paths P and Q are provided between a position to which the toner in the developer tank 111 is replenished and the developing roller 114. The first and second connecting paths "a" and "b" are provided to both ends of the first and second developer conveying paths P and Q and connect them. The first and second developer conveying members 112 and 113 are rotatably provided into the first and second developer conveying paths P and Q, respectively. The developing roller 114 supplies the toner to a surface of a photosensitive drum 3, and the developing device 2 develops an electrostatic latent image formed on the surface of the photosensitive drum 3.

An inside of the developer tank 111 is divided into two rooms by a partition wall 117 that is parallel with a shaft center direction of the developing roller 114. One of the two rooms on a side of the toner replenishment port 115*a* is the first developer conveying path P, and the other one on a side of the developing roller 114 is the second developer conveying path Q. The first developer conveying path P and the second developer conveying path Q are connected by the first connecting path "a" and the second connecting path "b" on both sides of the axial center direction. Therefore, the first and second developer conveying paths P and Q, and the first and second connecting paths "a" and "b" form one circular developer conveying path.

The developer tank 111 has semicylindrical inner wall surfaces 111*a* and 111*b* composing the first and second developer conveying paths P and Q, respectively.

The developer tank 111 has a developer tank cover 115 that composes its upper wall and is detachable. The developer tank cover 115 is formed with the toner replenishment port 115*a* for replenishing an unused toner to the downstream side of an external first developer conveying path Po in the developer conveying direction (a direction of an arrow Y), described later, composing the first developer conveying path P.

The developer tank 111 has an opening located between a sidewall on the side of the second developer conveyance path Q and a lower end edge of the developer tank cover 115. The development roller 114 is rotatably disposed in the position of the opening while a predetermined development nip portion N is provided between the development roller 114 and the photosensitive drum 3.

The development roller 114 is a magnet roller that rotates about the shaft center by a driving section (not illustrated). The development roller 114 bears the developer of the developer tank 111 on the surface thereof to supply the toner to the photosensitive drum 3. A development bias voltage is applied to the development roller 114 from a power supply (not illustrated) to supply the toner to the electrostatic latent image on the surface of the photosensitive drum 3 from the developer on the surface of the development roller 114.

The doctor blade 116 is a rectangular plate-like member that is extended in parallel with the shaft line direction of the development roller 114. A lower end 116*b* of the doctor blade 116 is fixed to the lower end edge of the opening of the developer tank 111, and an upper end 116*a* is separated from the surface of the development roller 114 with a predetermined gap. Examples of a material for the doctor blade 116 include stainless steel, aluminum, and synthetic resin.

The conducting plate 118 is a rectangular plate whose both ends are fixed to the developer tank 111. One of long sides of the conducting plate 118 is disposed on a position that does not contact with but is close to the surface of the developing roller 114, and the other long side is disposed above the first developer conveying path P.

The developer in the second developer conveying path Q is borne by the developing roller 114, and toner is supplied to the photosensitive drum 3. The developer remaining on the developing roller 114 is peeled from the surface of the developing roller 114 by the conducting plate 118. Thereafter, the developer slides along the conducting plate 118 to a direction of separating from the developing roller 114 so as to drop into the first developer conveying path P.

In this embodiment, the entire developer peeled from the surface of the developing roller 114 drops into the first developer conveying path P. However, a part of the developer peeled from the surface of the developing roller 114 may drop into the second developer conveying path Q.

<First Developer Conveying Member>

The first developer conveying member 112 includes a cylindrical hollow rotating shaft 112*a* with opened both ends, an external spiral blade 112*b*, an internal spiral blade 112*g*, internal spiral blade rotating shafts 112*h* and 112*i*, and a gear 112*j*. The hollow rotating shaft 112*a* divides the first developer conveying path P into the external first developer conveying path Po and an internal first developer conveying path Pi. The external spiral blade 112*b* is fixed to an outer periphery of the hollow rotating shaft 112*a*. The internal spiral blade 112*g* is fixed to an inner periphery of the hollow rotating shaft 112*a*. The internal spiral blade rotating shafts 112*h* and 112*i* are fixed to both ends of the internal spiral blade 112*g*. The gear 112*j* is provided to one end of the internal spiral blade rotating shaft 112*i* that penetrates one side wall 111*c* of the developer tank 111 in a longitudinal direction.

The hollow rotating shaft 112*a* is composed of a cylindrical member with opened both ends, and has a length that is shorter than the first developer conveying path P by a length of the first connecting path a.

A circular side surface portion of the hollow rotating shaft 112*a* on a downstream side of the internal first developer conveying path Pi is a side connecting port 112*k* (see FIG. 11). A circular side surface portion of the hollow rotating shaft 112*a* on an upstream side of the internal first developer conveying path Pi is a side connecting port 112*m* (see FIG. 10).

A spiral direction of the internal spiral blade 112*g* is opposite to spiral directions of the external spiral blade 112*b* and a spiral blade 113*b* of the second developer conveying member 113, described later. A conveying direction of the internal spiral blade 112*g* (a direction of an arrow X) is opposite to conveying directions (a direction of an arrow Y) of the external spiral blade 112*b* and the second developer conveying member 113.

An outer diameter of the external spiral blade 112*b* is set to about 20 to 50 mm, and a width is set to about 1 to 3 mm. An outer diameter of the internal spiral blade 112*g* is set to about 10 to 30 mm, and a width is set to about 1 to 3 mm.

The first embodiment illustrates a case where a spiral pitch of the external spiral blade 112*b* is equal to a spiral pitch of the internal spiral blade 112*g*. However, these spiral pitches may be different from each other, and for example, the spiral pitch of the external spiral blade 112*b* may be wider than that of the internal spiral blade 112*g*.

The first developer conveying member 112 is driven by a drive unit (for example, a motor), not shown, via the gear 112*j*. When the external spiral blade 112*b* rotates to a direction of an arrow J (see FIG. 2), as shown in FIG. 3 and FIG. 4, the developer in the external first developer conveying path Po is conveyed to the direction of the arrow Y, and the developer in the internal first developer conveying path Pi is conveyed to a direction of an arrow X.

At this time, the internal spiral blade rotating shaft is eliminated from the inside of the hollow rotating shaft 112*a* (except for both end portions), so that a space volume of the internal first developer conveying path Pi is increased and a conveying amount of the developer is increased.

A periphery connecting port 112*c* is provided to a cylindrical periphery of the hollow rotating shaft 112*a* on the downstream side of the external first developer conveying path Po. The periphery connecting port 112*c* connects the external first developer conveying path Po and the internal first developer conveying path Pi. This periphery connecting port 112*c* is arranged on a downstream side with respect to the external spiral blade 112*b*, and is formed into an approximately rectangular shape (about 10 mm×25 mm) that is long in a direction of the rotating shaft.

The developer conveyed from the external first developer conveying path Po or the second developer conveying path Q passes through the periphery connecting port 112*c* so as to transfer to the internal first developer conveying path Pi.

An inverse external spiral blade 112*e* whose spiral direction is opposite to that of the external spiral blade 112*b* is fixed to a downstream side of the outer periphery of the hollow rotating shaft 112*a* with respect to the periphery connecting port 112*c*. A developer drawing blade 112*d* with a rectangular plate shape is provided near the opening of the periphery connecting port 112*c* so as to be integrally continuous with ends of the external spiral blade 112*b* and the inverse external spiral blade 112*e*.

More specifically, the periphery connecting port 112*c* is arranged between the external spiral blade 112*b* and the inverse external spiral blade 112*e*. The developer drawing blade 112*d* is arranged on a rear side of the rotating direction with respect to the periphery connecting port 112*c* at the time when the hollow rotating shaft 112*a* rotates to the direction of the arrow J.

A ring-shaped backflow preventing plate 112*f* is provided to the upstream side of the external first developer conveying path Po, and is fixed to the outer periphery of the hollow rotating shaft 112*a* so as to contact with one end of the external spiral blade 112*b*.

At the time of the operation of this developing device 2, the developers that are conveyed to the downstream side of the external first developer conveying path Po and the downstream side of the second developer conveying path Q are collected in a space surrounded by the external spiral blade 112*b* and the inverse external spiral blade 112*e* and the developer drawing blade 112*d*. The collected developer is drawn to pass through the periphery connecting port 112*c* and be introduced into the internal first developer conveying path Pi in the hollow rotating shaft 112*a*.

At this time, while the periphery connecting port 112*c* is in the developer, the developer is sequentially introduced into the hollow rotating shaft 112*a*. However, the developer can be fed to the internal first developer conveying path Pi without increasing a stress excessively on the developer.

The developer that enters a gap between the side wall of the developer tank 111 on the side of the second connecting path "b" and the hollow rotating shaft 112*a* can flow also from the side connecting port 112*m* to the hollow rotating shaft 112*a* (the internal first developer conveying path Pi).

The toner replenishment port 115*a* is provided above the downstream side of the external first developer conveying path Po. A replenished toner and the developer are agitated by rotation of the developer drawing blade 112*d*, and while being quickly mixed, they are conveyed from the periphery connecting port 112*c* into the internal first developer conveying path Pi to be smoothly discharged out of the side connecting port 112*k*.

In this developing device 2, the shaft center position of the first developer conveying member 112 is higher than the shaft center of the second developer conveying member 113 in the vertical direction, and a lower position of the first developer conveying member 112 is lower than the shaft center of the second developer conveying member 113 in the vertical direction. Such a positional relationship can make the flow of the developer in the first connecting path "a" and the second connecting path "b" smooth, thereby repressing the stagnation of the developer.

<Second Developer Conveying Member>

The second developer conveying member 113 includes a rotating shaft 113*a*, the spiral blade 113*b*, a circumferential rotating plate 113*c*, and a gear 113*d*. The spiral blade 113*b* is fixed to the outer periphery of the rotating shaft 113*a*. The circumferential rotating plate 113*c* is provided to a position facing the second connecting path "b" on the downstream side of the second developer conveying path Q. The gear 113*d* is provided to one end of the rotating shaft 113*a* that penetrates one side wall 111*c* of the developer tank 111 in the longitudinal direction.

An outer diameter of the spiral blade 113*b* is set to about 20 to 40 mm, and a width is set to about 1 to 3 mm.

A spiral direction of the spiral blade 113*b* of the second developer conveying member 113 is the same as the spiral direction of the external spiral blade 112*b* of the first developer conveying member 112. The second developer conveying member 113 is driven by a drive unit (for example, a motor), not shown, via the gear 113*d*. When the spiral blade 113*b* rotates to a direction of an arrow K (see FIG. 2), as shown in FIG. 3, the developer in the second developer conveying path Q is conveyed to the direction of the arrow Y.

The circumferential rotating plate 113*c* is composed of four rectangular plates, and each one long side of each plate is fixed to the rotating shaft 113*a* so that the adjacent two plates form a right angle.

The developer sequentially conveyed from the upstream side of the second developer conveying path Q is pushed out towards the second connecting path "b" by rotation of the circumferential rotating plate 113*c* so as to transfer to the first developer conveying path P. At this time, since a backflow preventing protrusion 117*a* whose height is the same as that of the rotating shaft 113*a* is provided to a bottom portion of the second connecting path "b" in the developer tank 111, the circumferential rotating plate 113*c* represses the backflow of the developer transferred to the first developer conveying path P, thereby improving conveyance efficiency.

The toner density detecting sensor 119 is attached to an approximately center of the second developer conveying path Q just below the second developer conveying member 113 on the semicylindrical inner wall surface 111*b* in the developer tank 111. Its sensor surface is exposed inside the second developer conveying path Q.

The toner density detection sensor 119 is electrically connected to a toner density control section (not illustrated). According to a toner density measured value detected by the toner density detection sensor 119, the toner density control section rotates a toner discharging member 122 of the toner replenishment device 22 to be described later (see FIG. 11) and discharges the toner through a toner discharge port 123 to supply the toner into the first developer conveyance path P of the developing device 2.

When the toner density control section determines that the toner density measured value is lower than the toner density setting value, the toner density control section transmits a control signal to a driving section that rotates and drives the toner discharging member 122, and the driving section rotates the toner discharging member 122. For example, general toner density detection sensor such as a transmitted light detection sensor, a reflected light detection sensor, and a permeability detection sensor can be used as the toner density detection sensor 119. Among these, preferably the permeability detection sensor is used as the toner density detection sensor 119.

A power supply (not illustrated) is connected to the permeability detection sensor (toner density detection sensor 119). The power supply applies a driving voltage to the permeability detection sensor to drive the permeability detection sensor, and the power supply also applies a control voltage to the permeability detection sensor to output a detection result of the toner density to the control section. The voltage applied to the permeability detection sensor from the power supply is controlled by the control section. When the control voltage is applied to the permeability detection sensor, the permeability detection sensor outputs the detection result of the toner density as an output voltage value. Because basically the permeability detection sensor has good sensitivity near a median value of the output voltage, the control voltage is applied to the permeability detection sensor such that the output voltage near the median value is obtained. This kind of permeability detection sensor is commercially available. For example, product names TS-L, TS-A, and TS-K (TDK Corporation) can be cited as the permeability detection sensor.

(Toner Replenishment Device)

Figure 13:
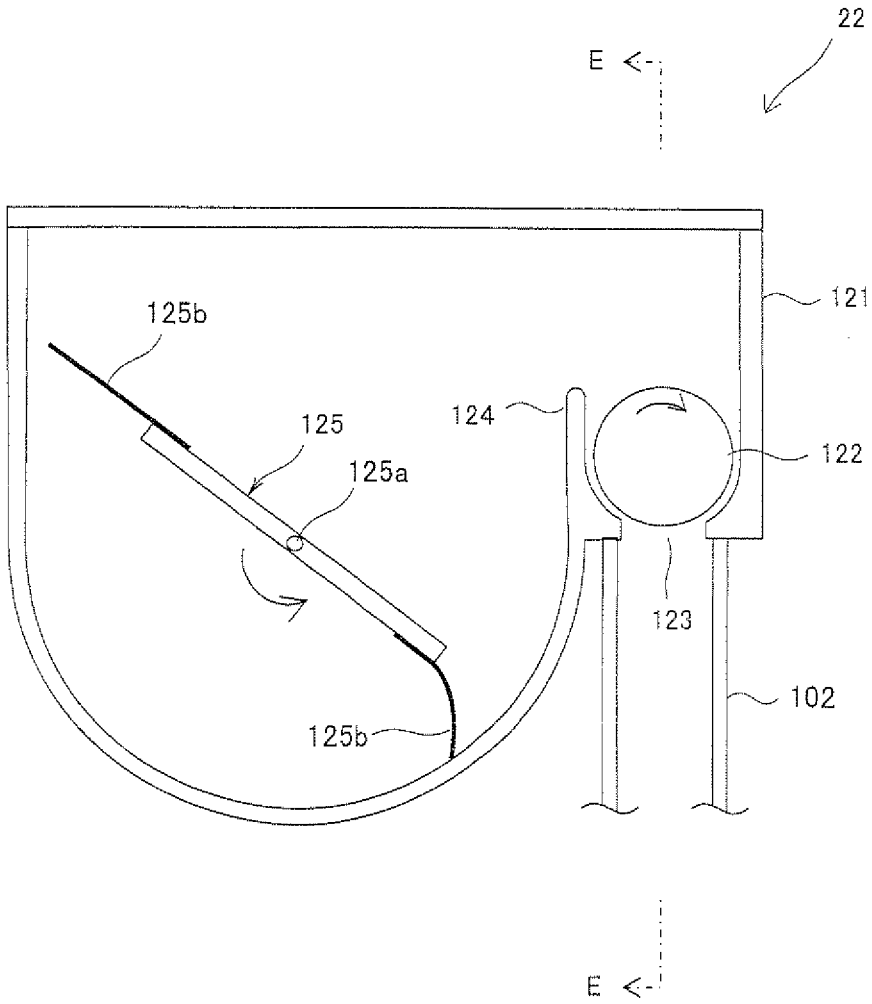
FIG. 13 is a schematic cross-sectional view illustrating a toner replenishment device in the developing device according to the first embodiment.
Figure 14:
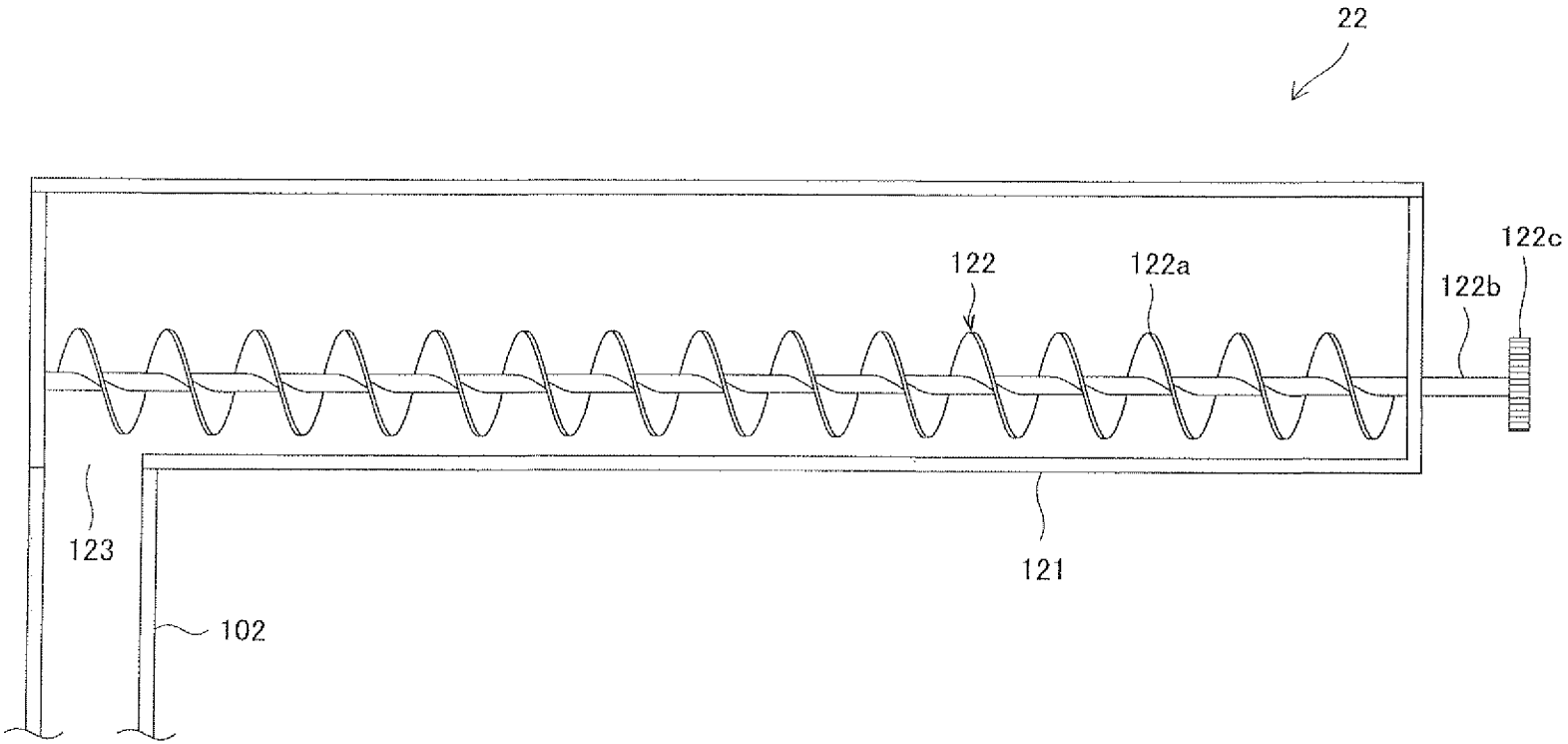
FIG. 14 is a fragmentary view taken in line E-E of FIG. 13.

FIG. 13 is a schematic sectional view illustrating the toner replenishment device in the developing device of the first embodiment, and FIG. 14 is a sectional view taken on a line E-E of FIG. 13. As illustrated in FIGS. 13 and 14, the toner replenishment device 22 includes a toner storage container 121 having the toner discharge port 123, a toner agitating member 125, and a toner discharging member 122. The unused toner is stored in the toner replenishment device 22. The toner replenishment device 22 is disposed above the developer tank 111 (see FIG. 1), and the toner discharge port 123 and the toner replenishment port 115*a* (see FIG. 2) of the developing device 2 are connected by a toner conveyance pipe 102. The toner storage container 121 is a substantially semi-cylindrical container member having an internal space, and the toner discharge port 123 is disposed at a lateral position in a circumferential direction of the semi-cylindrical part.

The toner agitating member 125 is rotatably disposed at the substantially central position in the semi-cylindrical part of the toner storage container 121, and the toner discharging member 122 is rotatably disposed above and near the toner discharge port 123. The toner agitating member 125 is a plate-like member that rotates about a rotating shaft 125*a*, and the toner agitating member 125 includes sheet-like toner scooping-up members 125*b* made of flexible resin (for example, polyethylene terephthalate) at both leading ends separated from the rotating shaft 125*a*. The rotating shaft 125*a* is rotatably supported on sidewalls on both sides in the longitudinal direction of the toner storage container 121, and one end of the rotating shaft 125*a* pierces the sidewall and is connected to a gear that engages a driving gear of a driving section (not illustrated).

The toner scooping-up member 125*b* rotates from below to upward with respect to the toner discharge port 123, whereby the toner agitating member 125 scoops up the toner stored in the toner storage container 121 to convey the toner to the toner discharging member 122 while agitating the toner. At this point, because of flexibility, the toner scooping-up member 125*b* rotates while being deformed by sliding along the inside wall of the toner storage container 121, and the toner scooping-up member 125*b* supplies the toner onto the side of the toner discharging member 122. A toner discharging member division wall 124 is provided between the toner discharging member 122 and the toner agitating member 125 such that the toner scooped up by the toner agitating member 125 can be retained a proper amount of toner around the toner discharging member 122.

The toner discharging member 122 includes a rotating shaft 122*b* whose both ends are rotatably supported on sidewalls on both sides in the longitudinal direction of the toner storage container 121, a spiral blade 122*a* that is fixed to an outer circumferential surface of the rotating shaft 122*b*, and a gear 122*c* that is fixed to one end of the rotating shaft 122*b*. The end of the rotating shaft 122*b* pierces the sidewall of the toner storage container 121. The gear 122*c* engages a driving gear of a driving section (not illustrated). The toner discharge port 123 is disposed on a position that is one end side of the spiral blade 122*a* opposite to the gear 122*c*. The toner is conveyed toward the side of the toner discharge port 123 by the spiral blade 122 by the rotation of the toner discharging member 122, and the toner is supplied from the toner discharge port 123 into the developer tank 111 through the toner conveyance pipe 102.

<Operation of Developing Device>

At a developing step of the image forming apparatus, as shown in FIG. 2 to FIG. 4, the developing roller 114, the first developer conveying member 112, and the second developer conveying member 113 of the developing device 2 rotate to the directions of arrows M, J and K, respectively.

At this time, the developer in the internal first developer conveying path Pi of the first developer conveying path P is conveyed to the direction of the arrow X by the internal spiral blade 112*g* of the first developer conveying member 112. Further, the developer in the second developer conveying path Q is conveyed to the direction of the arrow Y by the second developer conveying member 113.

At the same time, the developer on the downstream side of the internal first developer conveying path Pi of the first developer conveying path P passes through the first connecting path "a" to be fed to the second developer conveying path Q. Simultaneously, the developer on the downstream side of the second developer conveying path Q passes through the second connecting path "b" so as to be fed to the external first developer conveying path Po of the first developer conveying path P.

A part of the developer that transfers in the second developer conveying path Q is supplied to the developing roller 114.

The developer to be supplied to the developing roller 114 forms a developer layer on the outer periphery of the developing roller 114 into a uniform and predetermined thickness by the doctor blade 116, and is fed to the photosensitive drum 3. A part of toner is supplied from the developer layer to the photosensitive drum 3.

After an electrostatic latent image of the photosensitive drum 3 is developed, a recovery developer on the developing roller 114, which has lowered toner density and should be collected is peeled from the surface of the developing roller 114 by the conducting plate 118, slides along the conducting plate 118 to a direction separated from the developing roller 114. That recovery developer drops into the external first developer conveying path Po of the first developer conveying path P. At this time, the backflow preventing plate 112*f* prevents the dropped recovery developer from transferring towards a side closer to the first connecting path "a" than the hollow rotating shaft 112*a*.

Thereafter, the recovery developer in the external first developer conveying path Po is conveyed to the direction of the arrow Y by the rotating external spiral blade 112*b*. The recovery developer joins with the developer (inherent developer) that transferred in the second developer conveying path Q near the connecting path "b".

Since the toner density of the developer is detected by the toner density detecting sensor 119, when the toner density in the second developer conveying path Q is a predetermined value or less, unused toner is replenished from a toner replenishment device 22 to a developer that is collected to the downstream side of the external first developer conveying path Po of the first developer conveying path P.

In such a manner, the recovery developer, the inherent developer and the replenish toner are collected on the downstream side of the external first developer conveying path Po, and while being agitated by the developer drawing blade 112*d*, they pass through the periphery connecting port 112*c* to flow into the internal first developer conveying path Pi. While being agitated by the rotating internal spiral blade 112*g*, they are conveyed to the downstream side, and are transferred to the second developer conveying path Q.

During this time, the recovery developer, the inherent developer and the replenish toner are mixed uniformly so as to become a developer with uniform toner density, and simultaneously the toner is sufficiently charged by a friction with carrier.

(Intermediate Transfer Belt Unit and Intermediate Transfer Belt Cleaning Unit)

As illustrated in FIG. 1, the intermediate transfer belt unit 8 disposed above the photosensitive drum 3 includes an intermediate transfer belt 7, intermediate transfer roller 6*a*, 6*b*, 6*c*, and 6*d* (hereinafter, the numerals are unified by the numeral 6) that tension the intermediate transfer belt 7 thereabout to rotate the intermediate transfer belt 7 in the direction of arrow B of FIG. 1, a driving roller 71, a driven roller 72 and a belt tension mechanism (not illustrated), and a transfer roller 11 that is disposed beside the driving roller 71 while brought close to the driving roller 71. The intermediate transfer rollers 6 are supported on roller mounting portions in the belt tension mechanism. Additionally, an intermediate transfer belt cleaning unit 9 is disposed on the side of the driven roller 72 of the intermediate transfer belt unit 8.

The driving roller 71 and the driven roller 72 are disposed outside the photosensitive drums 3 located on both ends of the four photosensitive drums 3 such that the intermediate transfer belt 7 comes into contact with the photosensitive drums 3. The intermediate transfer belt 7 is formed in an endless manner using a film having a thickness of about 100 to about 150 μm. The toner images of the color components formed on the photosensitive drum 3 are sequentially transferred to and superposed on the outside surface of the intermediate transfer belt 7, thereby forming the color toner image (multi-color toner image).

The toner image is transferred from the photosensitive drum 3 to the intermediate transfer belt 7 by the intermediate transfer rollers 6 that are in contact with an inside surface of the intermediate transfer belt 7. The intermediate transfer roller 6 includes a metallic shaft (for example, stainless steel) having a diameter of 8 to 10 mm and a conductive elastic material layer. The outer circumferential surface of the metallic shaft is covered with the conductive elastic material layer. Examples of the material for the conductive elastic material layer include ethylene-propylene-diene ternary copolymer (EPDM) including a conductive agent such as carbon black and urethane foam. A high-voltage transfer bias (high voltage of a polarity (+) opposite toner charging polarity (−)) is applied to the metallic shaft of the intermediate transfer roller 6 in order to transfer the toner image, which allows the intermediate transfer roller 6 to evenly apply the high voltage to the intermediate transfer belt 7. In the first embodiment, the intermediate transfer roller 6 is used as the transfer electrode. In addition, for example, a brush may be used.

The toner images laminated on the outside surface of the intermediate transfer belt 7 is moved to the position (transfer portion) of the transfer roller 11 by the rotation of the intermediate transfer belt 7. On the other hand, the recording medium is also conveyed to the transfer portion through the sheet conveyance path S, and the transfer roller 11 presses the recording medium against the intermediate transfer belt 7, thereby transferring the toner images on the intermediate transfer belt 7 to the recording medium. At this point, the intermediate transfer belt 7 and the transfer roller 11 are pressed against each other at a predetermined nip, and the high voltage for transferring the toner image onto the recording medium having a polarity (+) opposite the toner charging polarity (−) is applied to the transfer roller 11. One of the transfer roller 11 and the driving roller 71 is made of a hard material such as metal while the other is made of a soft material such as rubber and a foaming resin such that the nip between the intermediate transfer belt 7 and the transfer roller 11 is steadily obtained.

The toner that is not transferred from the intermediate transfer belt 7 to the recording medium but left on the intermediate transfer belt 7 causes color mixture of the toner when the new toner image is laminated on the intermediate transfer belt 7. Therefore, the residual toner is removed and recovered by the intermediate transfer belt cleaning unit 9. The intermediate transfer belt cleaning unit 9 includes a cleaning blade that comes into contact with the intermediate transfer belt 7 to remove the residual toner and a toner recovery portion that recovers the removed toner. A part that is in contact with the cleaning blade in the intermediate transfer belt 7 is supported by the driven roller 72.

(Sheet Conveyance Path and Peripheral Members Thereof)

As illustrated in FIG. 1, the sheet conveyance path S is communicated with the sheet discharge tray 15 from the paper feeding tray 10 and the manual paper feeding tray 20 through the fixing device 12 to be described later. Pickup rollers 16*a* and 16*b*, conveyance rollers 25*a* to 25*f* (hereinafter, the numerals are unified by the numeral 25), a registration roller 14, a transfer roller 11, and a fixing device 12 are disposed around the sheet conveyance path S. The conveyance roller 25 is a small-size roller in order to promote and assist the sheet conveyance, and plural pairs of conveyance rollers 25 are provided along the sheet conveyance path S. The pickup roller 16*a* is provided in the end part of the paper feeding tray 10, and the pickup roller 16*a* is an attraction roller that supplies the sheet-like recording medium (recording sheet) one by one from the paper feeding tray 10 to the sheet conveyance path S. The pickup roller 16*b* is provided near the manual paper feeding tray 20, and the pickup roller 16*b* is an attraction roller that supplies the recording medium one by one from the manual paper feeding tray 20 to the sheet conveyance path S. The registration roller 14 tentatively retains the recording medium conveyed through the sheet conveyance path S, and the registration roller 14 conveys the recording medium to the transfer portion at the time the leading end of the toner image on the intermediate transfer belt 7 is aligned with the leading end of the recording medium.

[Fixing Device Accommodation Portion]

As illustrated in FIG. 1, the fixing device 12 accommodated in the fixing device accommodation portion 100B includes a heat roller 81 and a pressure roller 82, which rotate mutually reversely while the recording medium to which the toner image is transferred is interposed therebetween, a conveyance roller 25*b*, and a sheet discharge roller 25*c*. The heat roller 81 is controlled by a controller (not illustrated) so as to become a predetermined fixing temperature. The controller controls the temperature at the heat roller 81 based on a detection signal from a temperature detector (not illustrated). The heat roller 81 that is raised to the fixing temperature and the pressure roller 82 are pressed against the recording medium to melt the toner, thereby fixing the toner image on the recording medium. The recording medium to which the toner image is fixed is conveyed to an inversion sheet discharge path of the sheet conveyance path S by the conveyance roller 25*b* and the sheet discharge roller 25*c*, and the recording medium is discharged onto the sheet discharge tray 15 while inverted (in the state in which the toner image is oriented downward).

<Second Embodiment>

(Developing Device)

Figure 15:
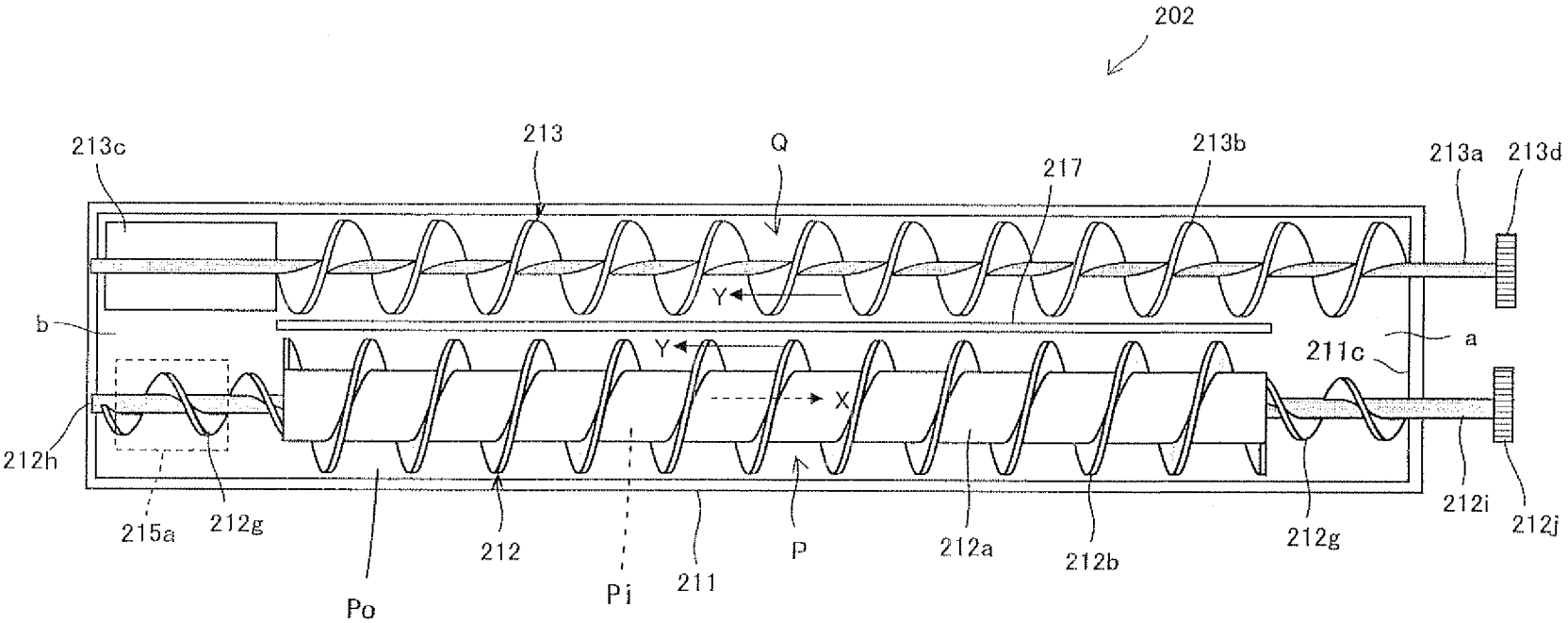
FIG. 15 is a plan sectional view illustrating the developing device according to a second embodiment of the present invention.
Figure 16:
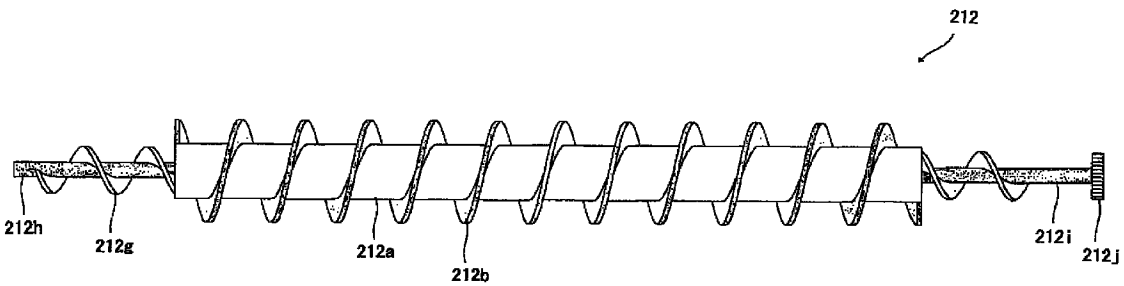
FIG. 16 is an enlarged diagram illustrating the first developer conveying member shown in FIG. 15.
Figure 17:
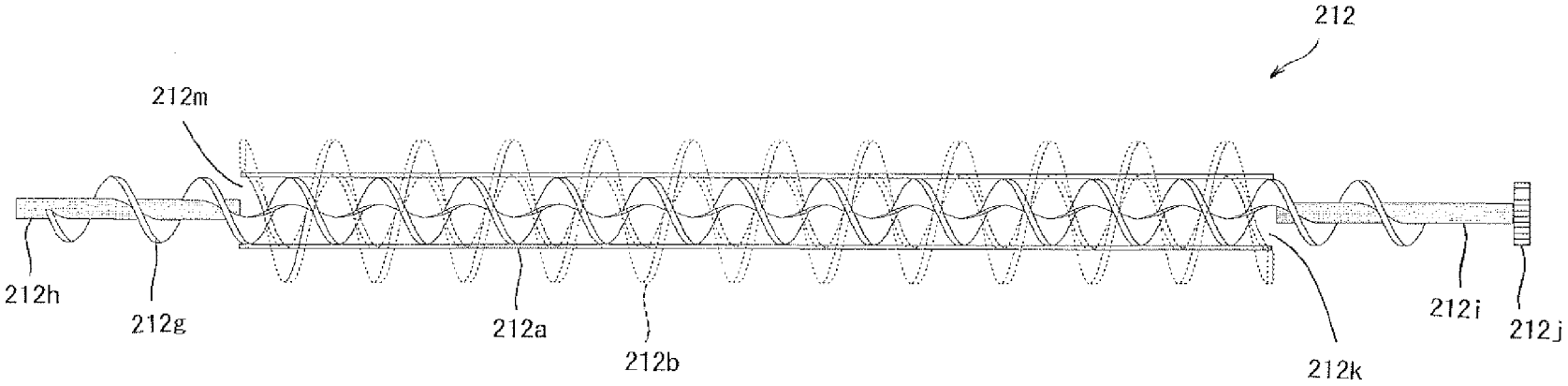
FIG. 17 is a perspective view illustrating the first developer conveying member shown in FIG. 16.

FIG. 15 is a plan sectional view illustrating the developing device according to a second embodiment of the present invention. FIG. 16 is an enlarged diagram illustrating the first developer conveying member shown in FIG. 15. FIG. 17 is a perspective view illustrating the first developer conveying member shown in FIG. 16. In FIG. 15 to FIG. 17, the elements similar to those in the first embodiment are denoted by the same reference symbols as those in the first embodiment, or head numbers of the symbols are changed from "1" into "2".

Since a developing device 202 according to the second embodiment of the present invention has the constitution equivalent to the developing device in the first embodiment except for a constitution of a first developer conveying member 212, only the first developer conveying member is described.

<First Developer Conveying Member>

As shown in FIG. 16 and FIG. 17, the first developer conveying member 212 includes a cylindrical hollow rotating shaft 212*a* with opened both ends, an external spiral blade 212*b*, an internal spiral blade 212*g*, internal spiral blade rotating shafts 212*h* and 212*i*, and a gear 212*j*. The hollow rotating shaft 212*a* divides the first developer conveying path P into the external first developer conveying path Po and the internal first developer conveying path Pi. The external spiral blade 212*b* is fixed to an outer periphery of the hollow rotating shaft 212*a*. The internal spiral blade 212*g* is fixed to an inner periphery of the hollow rotating shaft 212*a*. The internal spiral blade rotating shafts 212*h* and 212*i* are provided to both ends of the internal spiral blade 212*g*. The gear 212*j* is provided to one end of the internal spiral blade rotating shaft 212*i* that penetrates one side wall 211*a* of a developer tank 211 in a longitudinal direction.

The hollow rotating shaft 212*a* in the second embodiment has a length that is the approximately same as that of a partition wall 217. Side connecting ports 212*k* and 212*m* at both ends of the hollow rotating shaft 212*a* are arranged on positions that are the approximately same as both ends of the partition wall 217.

Only the external spiral blade 212*b* is fixed between both ends on the outer periphery of the hollow rotating shaft 212*a*, and the periphery connecting port 112*c*, the inverse external spiral blade 112*e* and the backflow preventing plate 112*f* in the first embodiment are omitted.

That is to say, in the second embodiment, the first developer conveying member 212 is simplified, and the other parts of the constitution are similar to those in the first embodiment.

Also in a case of this developing device 202, when the first developer conveying member 212 is driven by a drive unit, not shown, (for example, a motor) via the gear 212*j*, a developer in the external first developer conveying path Po is conveyed to the direction of the arrow Y. Further, a developer in the internal first developer conveying path Pi is conveyed to the direction of the arrow X.

In this case, an inherent developer, a recovery developer and a replenish toner collected around the internal spiral blade 212*g* are agitated and mixed by the internal spiral blade 212*g*, and simultaneously are introduced into the hollow rotating shaft 212*a*.

<Another Embodiment>

1. In the second embodiment, a portion of the internal spiral blade 212*g* of the first developer conveying member 212 facing the second connecting path b may be enlarged to the size of an outer diameter of the external spiral blade 212*b*. In this case, it may be gradually enlarged from a side of the hollow rotating shaft 212*a*.

As a result, while the developer and the replenish toner collected on the downstream side of the internal first developer conveying path Po are being agitated, they can be introduced into the hollow rotating shaft 212*a* (the internal first developer conveying path Po) more smoothly.

2. In the second embodiment, the backflow preventing plate 112*f* used in the first embodiment may be provided to an end of the upstream side of the external spiral blade 212*b*.

3. In the first embodiment, the portion of the internal spiral blade 112*g* of the first developer conveying member 112 facing the first connecting path "a" may be enlarged so that its lead angle is parallel (lead angle: 90°) with the rotating shaft 112*j*. In this case, it may be gradually enlarged from the side of the hollow rotating shaft 112*a*.

As a result, a force for pushing the developer discharged from the hollow rotating shaft 112*a* to the side wall 111*c* of the developer tank 111 is reduced, and a force for rotation about the rotating shaft center is increased. For this reason, while a stress on the developer is being reduced, the developer can be smoothly transferred to the first connecting path "a".

The same is true in the second embodiment.

4. In the first embodiment, the portion of the internal spiral blade 112*g* of the first developer conveying member 112 facing the first connecting path "a" is omitted, and a circumferential rotating blade similar to the circumferential rotating plate 113*c* of the second developer conveying member 113 may be provided instead.

As a result, the force for pushing the developer discharged from the hollow rotating shaft 112*a* to the side wall 111*c* of the developer tank 111 is reduced, and the force for the rotation about the rotating shaft center is increased. For this reason, while the stress on the developer is being reduced, the developer can be smoothly transferred to the first connecting path "a".

The same is true in the second embodiment.

5. The spiral direction of the spiral blade 113*b* of the second developer conveying member 113 in the first embodiment may be inverted, and the rotating direction of the second developer conveying member 113 may be inverted. In another manner, the spiral directions of the external spiral blade 112*b*, the inverse external spiral blade 112*e* and the internal spiral blade 112*g* of the first developer conveying member 112 in the first embodiment may be inverted. Further, the rotating direction of the first developer conveying member 112 may be reversed. Also in this case, the developer drawing blade 112*d* is connected to the external spiral blade 112*b* and the inverse external spiral blade 112*e*.

The same is true in the second embodiment.

6. The two internal spiral blade rotating shafts 112*h* and 112*i* of the first developer conveying member 112 in the first embodiment may be replaced by one internal spiral blade rotating shaft. In this case, an outer diameter of the internal spiral blade rotating shaft inside the hollow rotating shaft 112*a* may be narrower than that of both the ends.

What is claimed is:

1. A developing device, which is attached to an electrophotographic type image forming apparatus having a photosensitive drum on which an electrostatic latent image is formed, comprising:

a developer tank housing a developer including a toner and a carrier;

a toner replenishment port for replenishing a toner into the developer tank;

a developing roller that is provided in the developer tank and supplies the toner to a surface of the photosensitive drum formed with the electrostatic latent image while bearing the developer and rotating;

a developer conveying path having a first developer conveying path and a second developer conveying path on a side of the developing roller in which the first and second developer conveying paths are partitioned by a partition wall parallel with an axial direction of the developing roller, and a connecting path for connecting the first and second developer conveying paths at both sides of the axial direction;

a conducting plate for peeling a recovery developer on the surface of the developing roller after the toner is supplied to the photosensitive drum from the surface of the developing roller so as to guide the recovery developer to the first developer conveying path; and first and second developer conveying members arranged on the first and second developer conveying paths, wherein the first developer conveying member has a cylindrical hollow rotating shaft with opened both ends that is rotatably provided to the first developer conveying path, and divides the first developer conveying path into an external first developer conveying path and an internal first developer conveying path, an external spiral blade fixed to an outer periphery of the hollow rotating shaft, and an internal spiral blade fixed to an inner periphery of the hollow rotating shaft, a direction where the developer is conveyed by the external spiral blade is the same as a direction where the developer is conveyed by the second developer conveying member and is opposite to a direction where the developer is conveyed by the internal spiral blade.

2. A developing device according to claim 1, wherein the first developer conveying member includes a periphery connecting port and a developer drawing blade, the periphery connecting port is formed on a cylinder periphery of the hollow rotating shaft on the downstream side of the developer conveying direction in the external first developer conveying path, and connects the external first developer conveying path and the internal first developer conveying path, the developer drawing blade is fixed to a vicinity of the periphery connecting port on the outer periphery of the hollow rotating shaft, and leads a developer on a side of the external first developer conveying member to the internal first developer conveying path via the periphery connecting port at the time of rotation of the first developer conveying member.

3. A developing device according to claim 1, wherein the second developer conveying member includes a rotating shaft, and a spiral blade fixed to an outer periphery of the rotating shaft, a position of a shaft center of the first developer conveying member is set to be higher than a shaft center of the second developer conveying member in a vertical direction, a lower position of the first developer conveying member is set to be lower than the shaft center of the second developer conveying member in the vertical direction.

4. A developing device according to claim 3, wherein the second developer conveying member includes a circumferential rotating plate that is fixed along a direction of the rotating shaft on the downstream side of the developer conveying direction on the outer periphery of the rotating shaft.

5. A developing device according to claim 1, wherein the first developer conveying member includes a ring-shaped backflow preventing plate fixed to the upstream side of the developer conveying direction of the external first developer conveying path on the outer periphery of the hollow rotating shaft.

6. A developing device according to claim 1, wherein the first developer conveying member includes a side connecting port on the downstream side of the developer conveying direction of the internal first developer conveying path of the hollow rotating shaft.

7. A developing device according to claim 1, wherein the toner replenishment port is arranged on the downstream side of the developer conveying direction of the external first developer conveying path.

8. An image forming apparatus comprising: a photosensitive drum on which an electrostatic latent image is formed; a charging device for charging a surface of the photosensitive drum; an exposing device for forming an electrostatic latent image on the surface of the photosensitive drum; the developing device according to claim 1 for supplying a toner to the electrostatic latent image on the surface of the photosensitive drum so as to form a toner image; a toner replenishment device for replenishing a toner to the developing device; a transfer device for transferring the toner image on the surface of the photosensitive drum onto a recording medium; and a fixing device for fixing the toner image onto the recording medium.

* * * * *